US005727620A

United States Patent [19]

Schäufele et al.

[11] Patent Number: 5,727,620

[45] Date of Patent: Mar. 17, 1998

[54] RIM SEALED PLATE-TYPE HEAT EXCHANGER

[75] Inventors: Günter Schäufele, Karlsruhe; Zhangeng Guo, Stuttgart, both of Germany

[73] Assignee: Schmidt-Bretten GmbH, Bretten, Germany

[21] Appl. No.: 554,656

[22] Filed: Nov. 8, 1995

[30] Foreign Application Priority Data

Feb. 23, 1995 [DE] Germany ..... 195 06 281.7

[51] Int. Cl.[6] ..... F28F 3/00

[52] U.S. Cl. ..... 165/166; 165/167; 165/DIG. 369

[58] Field of Search ..... 165/167, 166, 165/DIG. 367, DIG. 369

[56] References Cited

U.S. PATENT DOCUMENTS

| | | | |
|---|---|---|---|
| 4,377,204 | 3/1983 | Johansson | 165/166 |
| 4,432,415 | 2/1984 | Wright | 165/166 |
| 4,556,106 | 12/1985 | Evans | 165/166 |
| 4,905,758 | 3/1990 | Mathur et al. | 165/166 |
| 4,995,455 | 2/1991 | Mathur | 165/166 |
| 5,178,212 | 1/1993 | Nakamura | 165/166 |

FOREIGN PATENT DOCUMENTS

| | | | |
|---|---|---|---|
| 8 436 | 12/1984 | Austria . | |
| 0 039 229 | 11/1981 | European Pat. Off. . | |
| 0 147 453 B1 | 7/1985 | European Pat. Off. . | |
| 0 450 188 A1 | 10/1991 | European Pat. Off. . | |
| 5203383 | 8/1993 | Japan | 165/167 |
| 0416550 | 9/1981 | U.S.S.R. | 165/166 |
| 1726965 | 4/1992 | U.S.S.R. | 165/167 |
| 2 028 996 | 3/1980 | United Kingdom . | |
| 2075656 | 11/1981 | United Kingdom | 165/166 |
| 2071303 | 9/1991 | United Kingdom | 165/166 |
| WO 91/13310 | 9/1991 | WIPO . | |

*Primary Examiner*—Denise L. Ferensic
*Assistant Examiner*—Christopher Atkinson
*Attorney, Agent, or Firm*—Frishauf, Holtz, Goodman, Langer & Chick, P.C.

[57] ABSTRACT

The seal (3) is provided with a plurality of laterally projecting attachment portions (14, 20, 814, 30, 31), located at longitudinally spaced positions along the seal. The rim (R) of the plate is formed with a plurality of recesses (19, 21, 33, 34) which extend laterally from the groove (10) in a direction essentially perpendicular to the groove at the locations of the attachment portions. The recesses, formed as cuts from the edge (15) (15') of the rim (R, R') are open to the terminal edge of the rim (R), so that, for placement or replacement of the seal, the seal, or seal portions, e.g., after loosening from the groove (10), can be readily slid outwardly of the groove by gripping the attachment portions. The seal (3) and the attachment portions are protected by the portion of the rim (R, R') extending beyond the recesses.

22 Claims, 8 Drawing Sheets

RIM SEALED PLATE-TYPE HEAT EXCHANGER

FIELD OF THE INVENTION

The present invention relates to a plate-type heat exchanger and, more particularly, to the seal structure which seals essentially parallel plates, between which a heat exchange medium can flow, to prevent escape of the heat exchange medium, typically a fluid, from between the plates.

BACKGROUND

Plate-type heat exchangers usually have a plurality of heat exchange plates, stacked in alignment next to each other. Usually, one of a pair of the plates has a circumferential groove along the rim thereof to receive a seal. The seal may have a plurality of essentially uniformly distributed projections or protrusions, formed parallel to the plates, and have attachment regions at their ends. These protrusions can be in engagement with the groove in the rim of the plate.

Usually, a substantial number of such plates are located in alignment in a stack. The stack may be hung or otherwise retained in a frame. The plates are pressed together by suitable compression or clamping elements, for example, by compressions plates and screw connections, located at the ends of the stack. The spaces between the plates, through which the heat exchange medium, or media, typically in fluid form, are guided, are sealed toward the outside by suitable sealing material, located around a circumference of the plates. The seal is clamped between the plates and retained by the clamping force in position also when the heat exchange medium, which is in the spaces between the plates, is pressurized. Circumferential seals may also be used, separate from the plate seals, in order to seal connections to the medium, or media, which are conducted to the heat exchanger.

The seal may have to be replaced from time to time or, for example, if it is damaged in operation of the heat exchanger. Consequently, the seal must be releasably coupled to the plates. It is known to secure the circumferential plate seal to be releasable from their attachment points from the respective plate. Suitable attachment points or elements are, for example, headed buttons or the like, for example, in mushroom shape, which are pressed into openings formed in the rim of the respective heat exchange plate, or buttoned therein. To replace a circumferential seal of this type is time-consuming and stressful on the hands of the operator carrying out the replacement.

It has also been proposed to form one or two adjacent projections from the seal with a bridge element, located outside of the rim of the respective plate and extending parallel to the seal. One or more flaps facing backwardly towards the seal may extend from the bridge, the flap engaging a plate at the side remote from the projections or protrusions. This arrangement has the disadvantage that externally projecting parts or portions of the seal extend outside of the outline of the plate stack. These externally projections portions or parts not only are subject to mechanical damage but, if exposed to radiation, and especially ultra-violet (UV) radiation, the externally projecting parts or portions may become brittle, and then cannot function as intended.

THE INVENTION

It is an object to provide a heat exchanger having a circumferential seal, in which the seal structure can be easily and rapidly assembled to the heat exchanger and, if necessary, replaced, and without being subject to physical damage or environmental attack from outside of the heat exchanger.

Briefly, the plate carrying the seal is formed at its rim portion with a circumferential groove which, in accordance with the present invention, is additionally formed with cut-out recesses adjoining the groove which are open to the edge of the rim of the plate. This edge of the rim can be the outer edge of the plate or it can be the inner edge of the rim which leads to the heat exchange space, within which the medium, or media subjected to heat exchange, will be located.

This simple arrangement in accordance with the invention makes it possible to push projections, forming also attachment elements joined to the seal from outside the rim of a plate into the recesses which, generally, are U-shaped in cross-section. This results in replacement, or assembly work which is substantially simpler and requiring less force than heretofore. It has been found that the assembly time for a seal in accordance with the invention can be reduced to about one quarter of that required for prior art seals. The arrangement in accordance with the present invention insures also that, if the seal is subjected to pressurized heat exchange fluid, and hence is pressed slightly outwardly, the projection, forming also attachment elements will not be squeezed, or damaged or, in the worst case, cut by an edge which terminates the recess at its end remote from the groove.

The attachment elements preferably are projections from the seal, which extend essentially perpendicularly with respect to the longitudinal direction of the seal, and can be formed as or on extending flaps or tabs. The part of the rim of the plate which will receive the extending flaps or tabs preferably is formed to have the same level as the base of the groove in which the seal is located. This is not a requirement, however, and the region which receives the projections or protrusions from the seal may be upwardly stepped, with respect to the base of the groove, so that the outer walls of the groove will not be interrupted in their function as an abutment or support element in the region of the projections.

In accordance with a feature of the invention, attachment portions can be provided on the seal spaced from an outer edge, or an inner edge, e.g., adjacent a heat exchange medium duct, respectively, of the plate and extending perpendicularly to the projections in the direction of the parts carried one of the plates. This can be obtained by forming the attachment portions as, essentially, cylindrical, or conically expanding stub elements.

In accordance with another feature of the invention, the attachment portions may be formed with headed projections, which are joined to the seal itself by a neck portion of reduced cross-sectional area. The neck portion is then gripped by the edge of the upwardly, or inwardly extending recess. The head-like enlargements prevent undesired slippage of the attachment elements from the recesses.

The cross-section of the attachment elements transversely to their longitudinal extent can be suitably selected, for example in circular, elliptic or polygonal form. The attachment elements may also have a cross-section transverse to its longitudinal extent which essentially fills the generally U-shaped recesses in the rim of the plate, thereby insuring a stable and secure seat of the attachment elements within the plate itself.

Usually, the cross-section of the recesses leading to the groove essentially corresponds to the portion of the attachment element which is engaged in the recess. This cross-section of the recess can be uniform and unvarying from the groove towards the edge of the rim of the plate, for example, in the above-mentioned U-shape. Alternatively, the cross-section of the recess, starting from the position of the attachment element, may reduce towards the edge of the plate. This reduction can be slight. This arrangement has the advantage that, in advance of assembly of a stack of the plates, individual attachment elements, and hence the seal, will be clamped in position and will not inadvertently slip out of their desired placement positioned towards the edge of the respective plate.

The recesses may be formed, for example, at the edge of the plate, with a funnel-like enlargement, which facilitates locating the attachment elements in the recesses.

In accordance with another feature of the invention, two adjacent projections of the attachment elements can be connected in the form of a bridge by a connection element; the bridge, starting from the recesses associated with the projections with which is bridge is associated, can be located at the other side of a plate. Thus, the bridge can pass beneath the plate rim, starting from the ends of the projection. This arrangement, due to the outwardly open shape of the recesses, also permits simple assembly; since the bridge will be located within the outline of the rim, it is not accessibly positioned outside the rim of the stack of plates and, thus, is not subject to damage. Preferably, the portion of the rim of the plate over which the bridge extends is offset or reduced in dimension with respect to an adjacent portion in the direction of the bridge, in order to prevent sharp bending of the material forming the seal in the region of the junction between the projection and the bridge portion. A similar result can be achieved by a suitably stepped attachment junction or region between the bridge and the projections; the previously described offset solution, however, is preferred. The bridge may have a different thickness of material in a direction perpendicular to the surface of the plate than the projections. It is also preferable that the recesses are widened in the longitudinal direction of the rim of the plate with respect to the dimensions of the projections.

It is inherently obvious that the side of a plate remote from the seal up to the subsequent plate must provide sufficient space in the rim region for projecting portions of the attachment elements, which is a customary arrangement. If necessary, however, the rim of the plate following the one which carries the attachment element must be suitably shaped, profiled, or dimensioned to leave space for the ends of the attachment elements.

DRAWINGS

The drawings illustrate essential characteristics and details with respect to the present invention, as explained in the detailed description of the specification:

DETAILED DESCRIPTION

Figure 1:
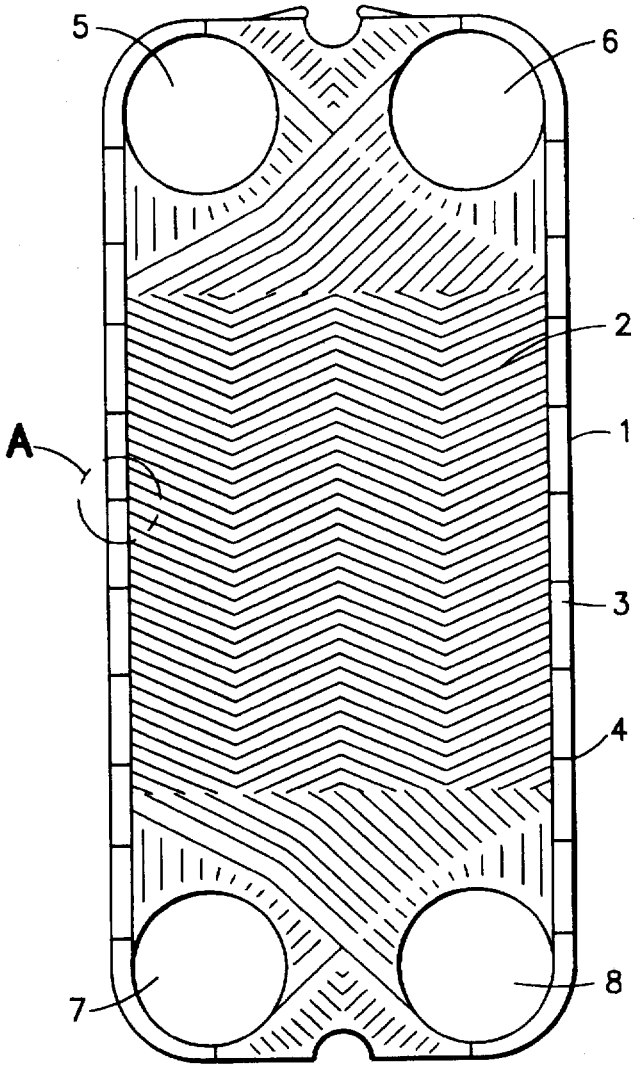
FIG. 1 is a top view of a heat exchange plate with a seal seated thereon.
Figure 2:
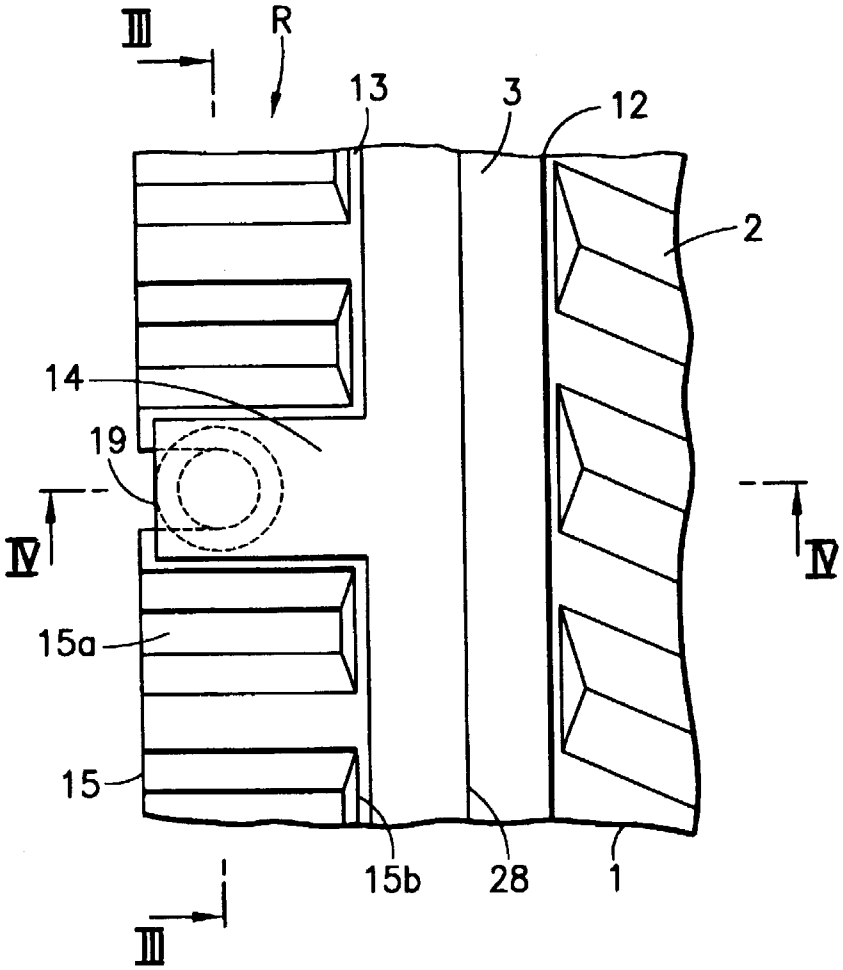
FIG. 2 is an enlarged detail view of the rim region within the circle A of FIG. 1.

Referring first to FIG. 1 which shows, highly schematically, the top view of a heat exchange plate 1, for example of stainless sheet steel. It is formed with an embossed profile 2 in the heat exchange region, which is surrounded by a rim R The rim can be partially embossed, as seen at 15*a*. The heat exchange region is surrounded by a rim of the plate. A circumferential seal 3 is located in the rim of the plate. The seal 3 is fitted in a circumferentially continuous groove 10 (FIG. 2). The seal 3 is formed with externally directed attachment elements in the form of projections or protrusions 4 which releasably engage the plate 1, as will be described in detail below. Openings 5, 6, 7, 8, also surrounded by the seal, are provided for conducting the heat exchange media, typically fluids, as well known, in spaces between adjacent plates.

Figure 1A:
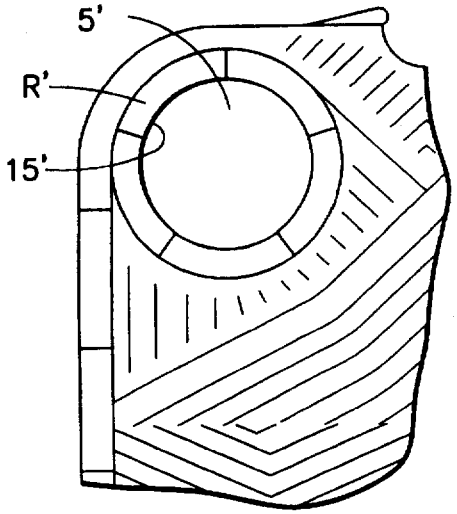
FIG. 1A is an enlarged fragmentary view of the plate portion surrounding a fluid supply opening.

FIG. 1A is a fragmentary view illustrating the portion of the plate surrounding an opening 5' for a heat exchange medium. The opening in the plate is defined by a rim portion R' surrounding the opening, having an inner edge 15'. As will appear below, the seal 3 can be fitted both on the outer rim R, as well as on the inner rim R'.

Figure 3:
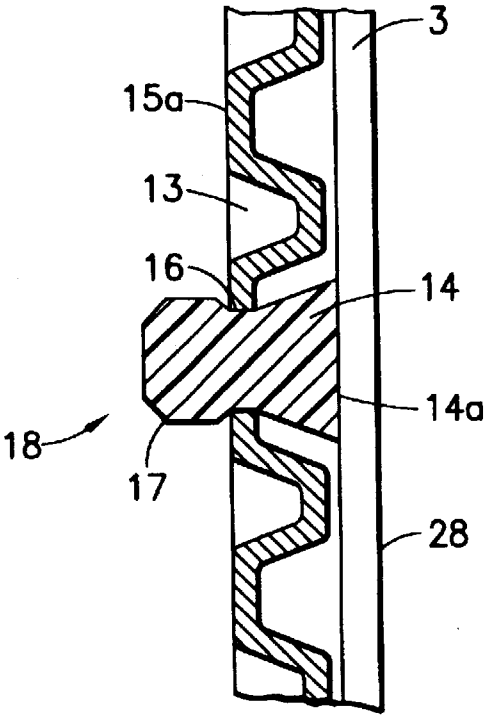
FIG. 3 is a cross-sectional view taken along line III—III of FIG. 2.
Figure 5:
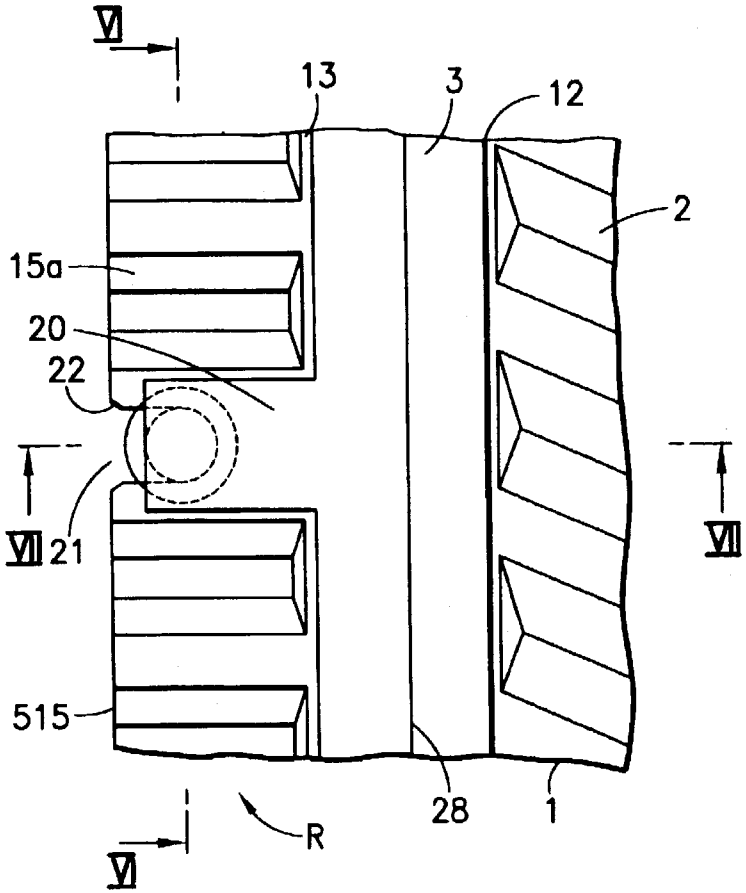
FIGS. 5, 6 and 7 are similar to FIGS,. 2, 3 and 4, but illustrating another embodiment.
Figure 4:
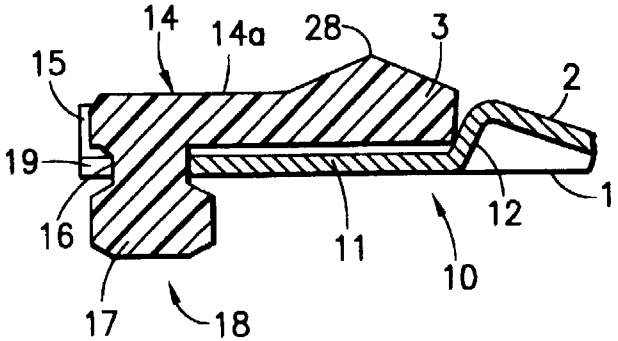
FIG. 4 is a cross-sectional view taken along line IV—IV of FIG. 2.

FIGS. 2, 3 and 4 illustrate, to a substantially enlarged scale, the seal and the portion of the plate within the circle A of FIG. 1. The seal 3 is seated in a continuous groove 10, embossed or otherwise formed in the plate 10. The groove 10 surrounds the heat exchange region. FIG. 5 illustrates a limiting wall 12 of the groove 10 which is at the inside of the plate 3; the outer limiting wall 13 can best be seen in FIGS. 2 and 3.

The seal 3 is formed with projections or protrusions 14 extending from the seal 3 in spaced locations, as best seen in FIG. 1. These projections 14 are in the form of flaps or tabs, which, as best seen in FIG. 4, extend with their surface facing the plate 1 at the same level as the bottom of the groove 11 towards the outer edge 15 of the rim R of the plate 1, in a direction perpendicular to the longitudinal direction of the seal 3. The free ends of the tabs 14 carry an attachment portion 18 formed by a head 17 and a neck portion 16 extending from a projecting portion 14*a* in a direction perpendicular to the plate 1.

Figure 3A:
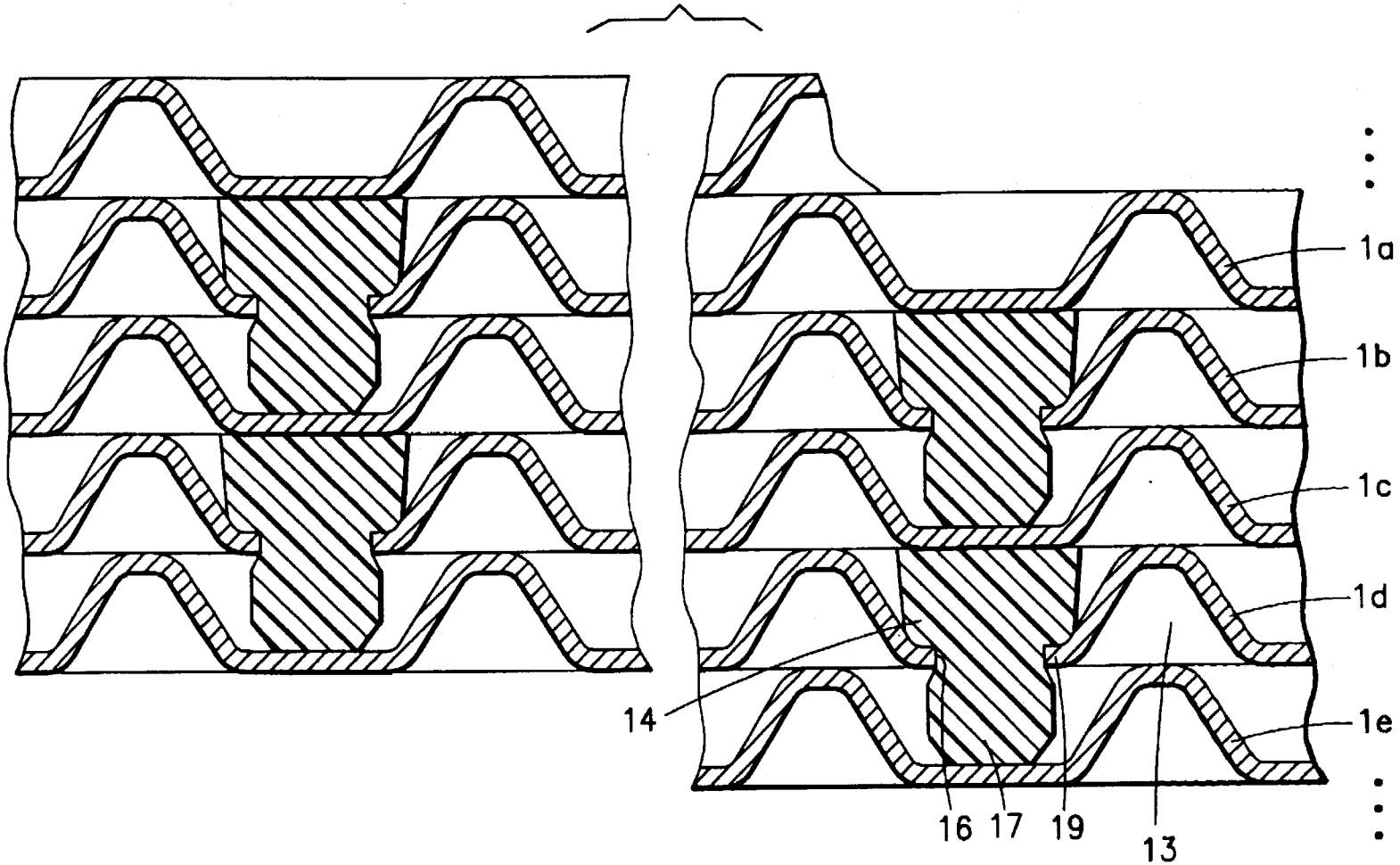
FIG. 3A is a view similar to FIG. 3 and showing a plurality of plates of a plate stack.

FIG. 3A shows a plurality of plates 1*a*, 1*b*, 1*c*, 1*d* of a plate stack, with protrusions 14 interposed.

In accordance with a feature of the invention, the attachment portions 18 are seated in U-shaped outwardly open recesses 19 in the rim R. These recesses 19 are open to the edge 15 of the rim R of the plate and tightly grip the neck portion 16 of the attachment portion 18.

The arrangement permits easy assembly of the seal by slipping the attachment portions 14 into the recesses 19 from outside of the plate. This permits rapid assembly without requiring manual dexterity or exertion of substantial manual force and, hence, reduce stress on the operator. Similarly, if a defective seal has to be replaced, the replacement is simple and fast.

Figure 4A:
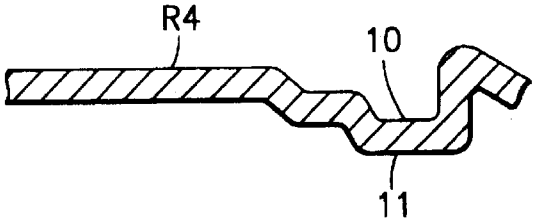
FIG. 4A is a fragmentary cross-section of FIG. 4, showing a modification.

Of course, the head 17 must have sufficient space with respect to the rim of the subsequent plate. This can be easily obtained by suitable shaping of the rim of the respective plate or the next plate, for example, by embossing. Of course, the cross-section of the seal 3 must be so dimensioned that it reaches the bottom of the groove of the subsequent plate. This is obtained in the present case by a roof-like rise 28 in the longitudinal cross-section of the seal 3 (see FIG. 4). The portion R4 of the rim R beneath the projection 14 can be stepped (see FIG. 4A).

Figure 6:
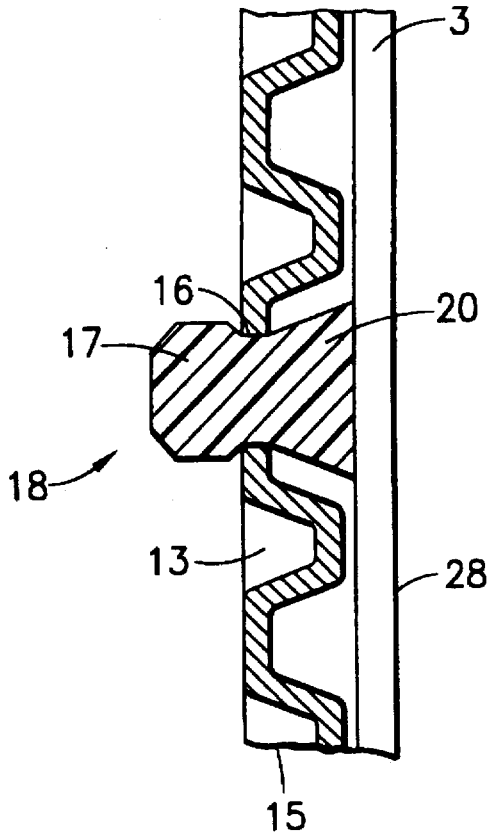
Figure 7:
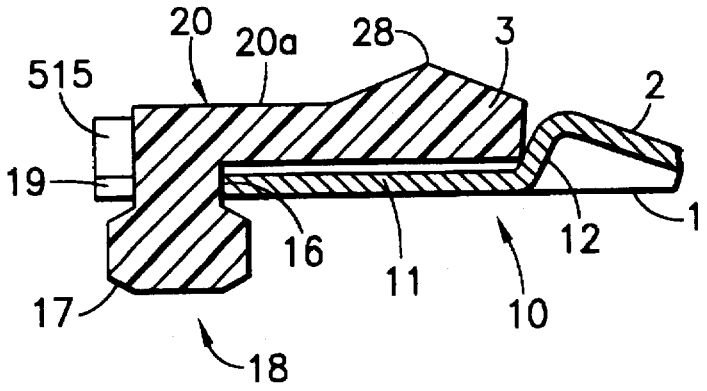

FIGS. 5, 6 and 7 show, in similar presentation, another embodiment of the present invention, in which elements identical to those previously described have been given the same reference numerals, and elements which have been modified have been given the same reference numerals, incremented by 500.

The modification, as best seen in FIGS. 5 and 7, is the reduction in length of the projection 20 with respect to the projection 14 of FIGS. 2–4. Thus, the head 17 of the attachment element 18 extends beyond the tab portion 20*a* of the projection 20. FIG. 5 illustrates yet another modification, which can be used with the modified projection 20, as well as the with projection 14 (FIGS. 2–4), namely, that the recess 21 in the region of the outer edge 515 of the rim of the plate 1 is formed with a funnel-like enlargement 22. This facilitates placement of the attachment portion 18 of the projection 20 in the recess 21.

Figure 9:
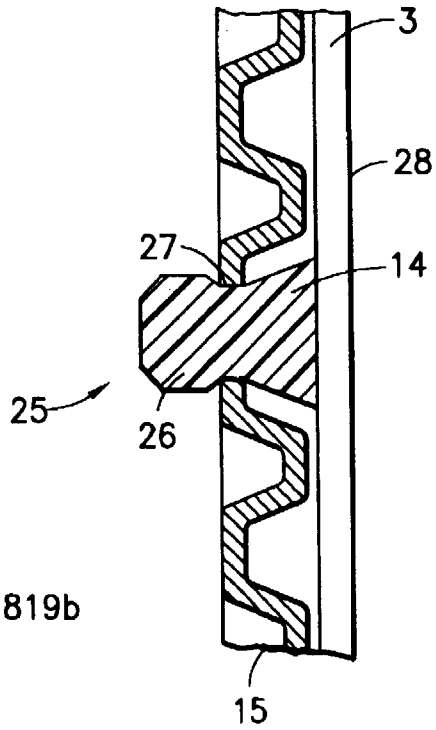
FIGS. 8, 9 and 10 are similar to FIGS. 2, 3 and 4 but illustrating yet another embodiment.
Figure 8A:
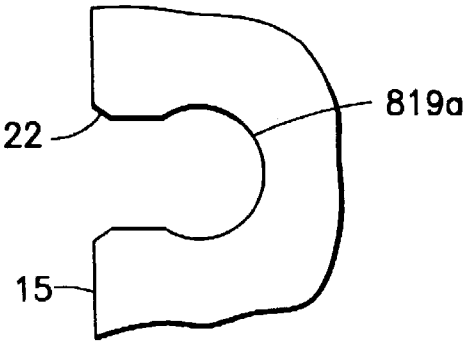
FIG. 8A is a highly schematic representation of a keyhole-type recess 819*a*.
Figure 8B:
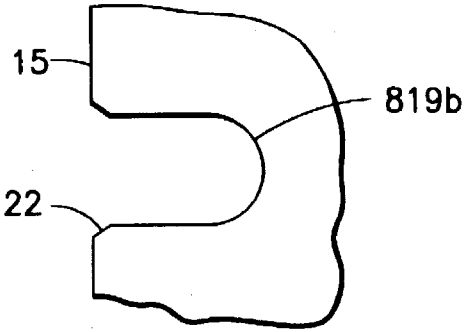
FIG. 8B is a highly schematic representation of a recess 819*b*, which has a constricted forward portion and a somewhat enlarged rearward portion.
Figure 8:
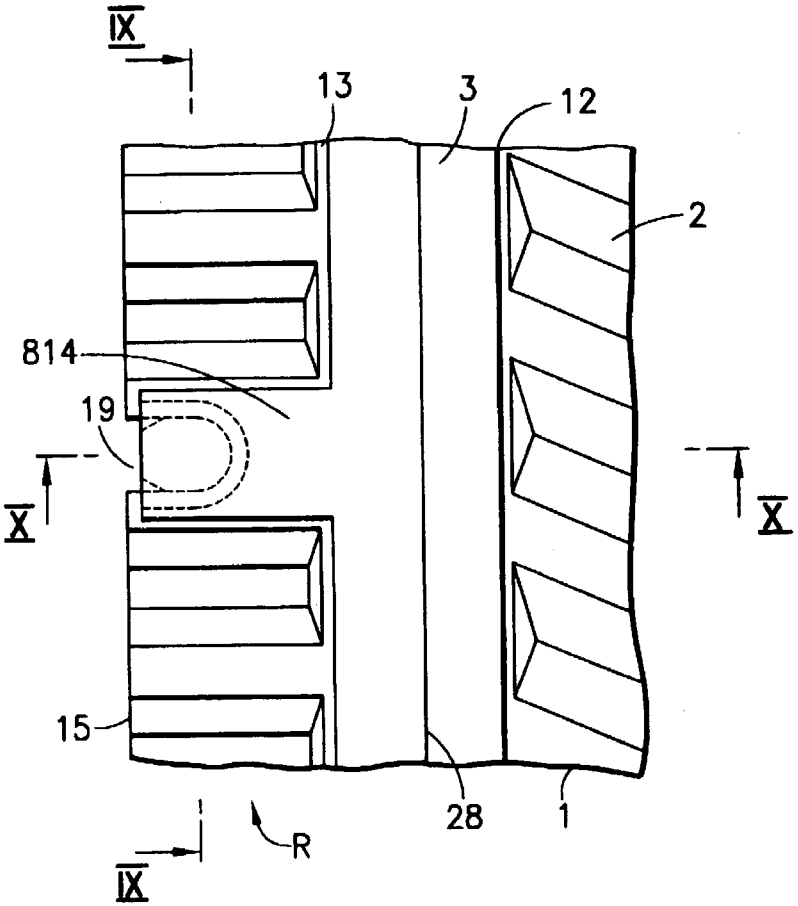
Figure 10:
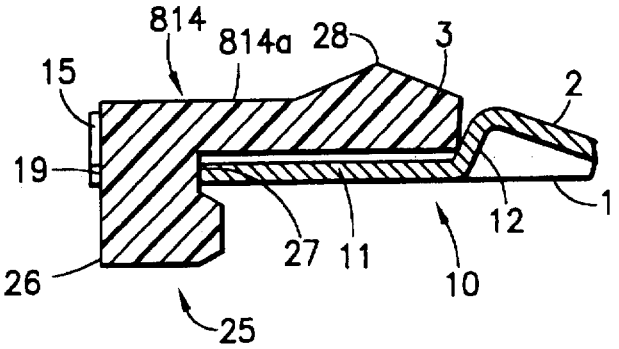

FIGS. 8–10 illustrate yet another embodiment of the present inventive matter, illustrated similar to FIGS. 2–4, in which elements described previously will not be described again; they have been given the same reference numerals and similar elements have been incremented by 800.

As best seen in FIG. 8, the attachment element 25 of the projection 814 is matched to the cross-section of the recess 19; this matched shape extends up to the end of the tab 814, and hence to the edge 15 of the plate 1.

Usually the cross-section of the portion of the plate 1 into which the tab 814, and then the head will fit, will be U-shaped. The shape of the recess 19 has been illustrated in the form of a U. This is not a necessary requirement, and other shapes are possible. Thus, the cross-section of the recess 19 outside of the attachment portion 18 and towards the edge 15 of the rim of the plate can be somewhat reduced so that the attachment portion 18, 25 must be pushed into the recess 19, 20 while overcoming a slight resistance. Thus, the shape of the recess 819*a* can be somewhat keyhole-shaped, see FIG. 8*a*, or the recess 819*b* can follow after a slight constriction at its outer portion, see FIG. 8*b*. FIGS. 8A and 8B also show the funnel-shaped enlargement 22, previously described in connection with FIG. 5.

The seal is slightly elastic, and can be readily fitted into a constricted recess such as the recess 819*a* or 819*b*, overcoming a resistance. This insures that the head portion 18 (FIGS. 2–7) or 25 (FIGS. 8–10) cannot shift after having been assembled.

Figure 11:
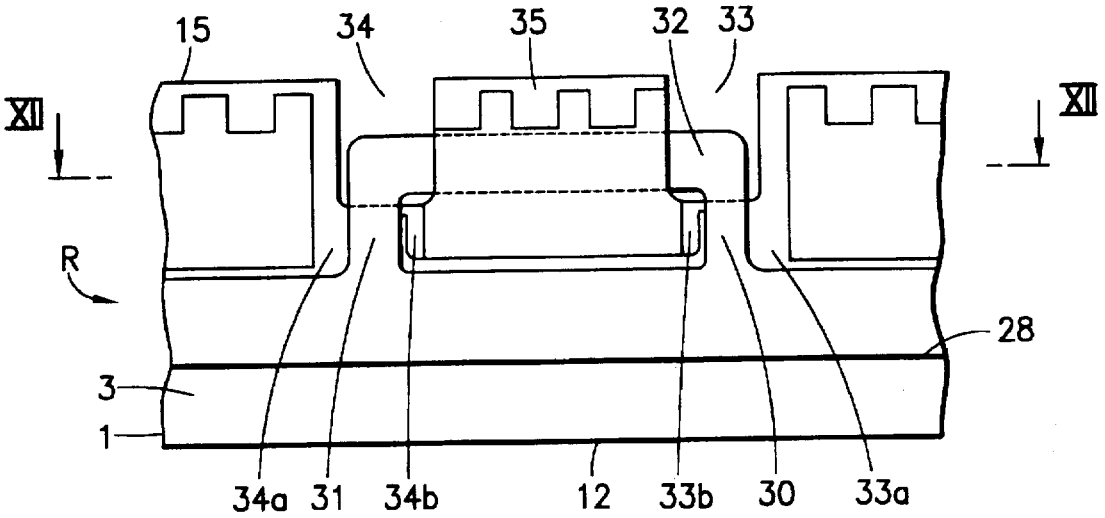
FIG. 11 is a view of another embodiment, into a different scale, of a seal, and showing the portion thereof within the circle A of FIG. 1.
Figure 12:
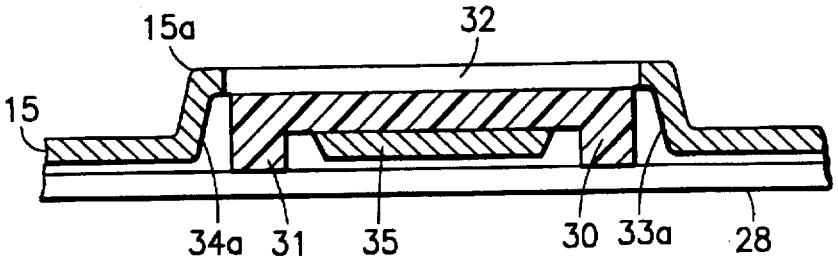
FIG. 12 is a cross-sectional view taken along line XII—XII of FIG. 11.
Figure 13:
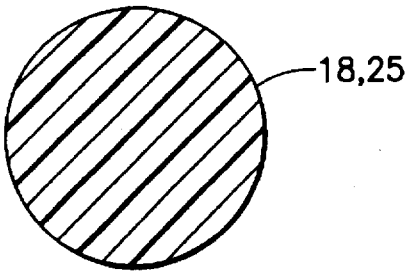
FIG. 13 is a cross-sectional view of an attachment projection having circular cross-section.
Figure 14:
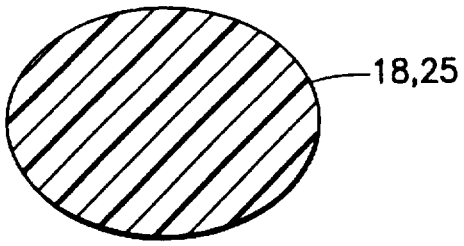
FIG. 14 is a cross-sectional view of an attachment projection having an elliptical cross-section.
Figure 15:
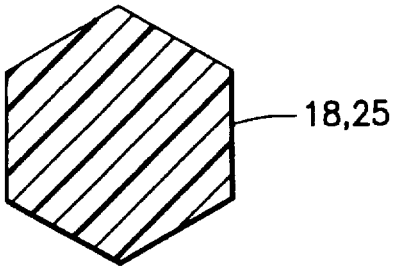
FIG. 15 is a cross-sectional view of an attachment projection having a polygonal cross-section.
Figure 16:
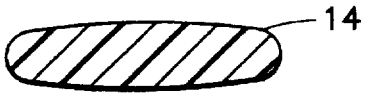
FIG. 16 is a cross-sectional view of a projection having an elongated cross-section.

FIGS. 11 and 12 illustrate another embodiment of the portion of the rim of a plate 1 within the circle A of FIG. 1; they are a top view, and cross-section taken along line XII—XII of FIG. 11, respectively.

In accordance with the embodiment of FIGS. 11 and 12, two adjacent projections 30, 31 of the seal 3 are coupled at their remote ends by a bridge 32. The bridge 32 is located inwardly of the edge 15 of the rim R of the plate 1, and connects the outer end portions of the projections 30, 31. The portion 35 of the rim of the plate 1 is preferably slightly offset, or narrowed (as best seen in FIG. 12) in a direction away from the bridge 32 so that the material forming the seal is stressed as little as possible in the region of the connection or junction between the bridge 32 and the projections 30, 31, respectively. The cross-section of the bridge 32, perpendicular to the surface of the plate 1, is preferably selected to be somewhat smaller than the cross-section of the projections 30, 31, respectively.

FIGS. 11 and 12 also show two offset portions 34*a*, 34*b*, 33*b*, 33*a*, adjacent each one of the respective projections 31, 30. FIGS. 11 and 12, taken together, clearly show that the respective offset portions 34*a*, 34*b*, 33*b*, 33*a*, when looked at from the position of an observer, are remote from the seal element itself.

Attachment or removal of the seal can be easily carried out by shifting the seal over the open recesses 33, 34. As a result, all portions which are needed to attach the seal between adjacent plates are then received in their intended position, while also being protected against damage due to external forces.

Various changes and modifications may be made. The described embodiments are only examples of structure realizations of the invention. This is particularly pertinent with respect to the dimensions, and relative dimensions, shown in the drawings. For example, the attachment elements 18 (FIGS. 2–7) and 25 (FIGS. 8–10) may have cross-sections which are circular; in accordance with requirements of design and particular applications, the respective projections can also be different. For example, a bridge, as described in connection with FIGS. 11 and 12, may connect more than two projections, for example three or more. It is also possible to utilize various types of projection configurations on one seal, for example by mixing the projections illustrated in FIGS. 2–10 on the one hand with the bridge-type, or connected projections illustrated in FIGS. 11 and 12, uniformly or randomly distributed over the length of the seal.

Other changes and modifications may be made, and any features described herein in connection with any one of the embodiments may be used with any of the others, within the scope of the inventive concept.

We claim:

1. Plate-type heat exchanger with a circumferential seal (3), said heat exchanger having at least two essentially parallel plates (1) adapted to be secured together with space therebetween to permit a heat exchange fluid to pass between the plates, each plate defining a rim (R, R'), wherein at least one (1) of said plates is formed with a circumferential groove (10) to receive the seal (3), wherein said seal (3) is formed with a plurality of projections (14, 20, 814, 30, 31) located at longitudinally spaced positions, with attachment portions (18, 25, 35) at their respective ends extending essentially perpendicularly to the longitudinal direction of the projections of the seal, said at least one plate is formed with recesses (19, 21, 33, 34) located laterally of the groove (10) in a direction essentially perpendicular to the groove (10), said recesses (19, 21, 33, 34) receiving said attachment portions (18, 25, 35) and being in engagement with said attachment portions; and in accordance with the invention, said heat exchanger comprising the improvement that the recesses (19, 21, 33, 34) receiving said attachment portions (18, 25, 35) are open to a terminal edge (15) of the rim (R, R') of the plate, whereby mounting of the seal (3) by insertion of said attachment portions from outside the heat exchanger is possible.

2. The heat exchanger of claim 1, wherein said recesses (19, 21, 33, 34) are open towards the outer edge (15) of an outer rim (R).

3. The heat exchanger of claim 1, wherein the recesses (19, 21, 33, 34) are open towards an inner edge (15') of an inner rim (R') formed on the plate.

4. The heat exchanger of claim 1, wherein the projections are formed as extending tabs.

5. The heat exchanger of claim 1, wherein the groove (10) defines a groove bottom (11); and wherein those portions of the rim (R) on which said projections (4, 14, 814, 30, 31) are lying have a level, with respect to the plate, which is similar to the bottom (11) of the groove.

6. The heat exchanger of claim 1, wherein the groove (10) defines a groove bottom (11);

and wherein those portions of the rim (R) on which said projections (4, 14, 814, 20, 30, 31) are lying are upwardly stepped with respect to the bottom of the groove (10).

7. The heat exchanger of claim 1, wherein the projections are formed with said attachment portions which form attachment elements (18, 25, 35) and which are inwardly spaced, with respect to the seal, from the edge (15) of the rim.

8. The heat exchanger of claim 7, wherein the attachment elements (18, 25) comprise projecting buttons or knobs (17, 25).

9. The heat exchanger of claim 1, wherein the attachment elements (18, 25) are essentially cylindrical or conical, expanding towards their terminal ends.

10. The heat exchanger of claim 9, wherein the attachment elements are formed with a headed enlargement (17).

11. The heat exchanger of claim 8, wherein the attachment elements (18, 25) have essentially circular, elliptical, or polygonal cross-section.

12. The heat exchanger of claim 1, wherein the projections (14, 20, 814, 30, 31) have an elongated cross-section extending toward the outer edge (15) of the rim (R) of the plate (1).

13. The heat exchanger of claim 8, wherein the cross-section of the recesses (19, 21) essentially corresponds to the cross-section of the attachment elements (18, 25), in engagement with the recesses.

14. The heat exchanger of claim 8, wherein the cross-section of at least some of the recesses are essentially uniform from an inner end to the edge (15) of the rim.

15. The heat exchanger of claim 8, wherein the cross-section of at least some of the recesses (**819*b*) decrease from an inner terminal end towards the edge (15) of the rim (R), or is keyhole-shaped (819*a***).

16. The heat exchanger of claim 1, wherein at least some of the recesses (21) are formed with a funnel-shaped enlargement (22) in the region of the edge (15) of the rim (R).

17. The heat exchanger of claim 1, wherein a bridge element (32) is provided, extending between two adjacent projections (30, 31) and forming, with said projections, a unitary attachment part; and wherein said bridge element (32), starting from the projections (30, 31) associated with the respective recesses (33, 34), is located at the opposite side, with reference to said two projections (30, 31) of said plate (1).

18. The heat exchanger of claim 17, wherein the portion of the rim (R) which is aligned with the bridge element (32) is narrowed with respect to the length of the bridge element.

19. The heat exchanger of claim 17, wherein the bridge element (32) has a thickness which is less than the thickness of the projecting portions (30, 31).

20. The heat exchanger of claim 17, wherein the recesses (33, 34) are widened with respect to the longitudinal dimension of the projections (30, 31).

21. The heat exchanger of claim 1, wherein the rim (R) of the second heat exchange plate has a rim portion shaped to permit placement of said projections of the seal on said one plate adjacent said second plate.

22. The heat exchanger of claim 1, wherein the rim (R) of the plate extends at least up to, and optionally, beyond the ends of the projections (14, 20, 814, 30, 31), whereby the projections are protected from damage.

* * * * *